US007867152B1

(12) United States Patent
Harris, Jr.

(10) Patent No.: US 7,867,152 B1
(45) Date of Patent: Jan. 11, 2011

(54) MULTI-AXIS, MULTI-PLANAR MULTI-EXERCISE COLLAPSIBLE EXERCISE DEVICE

(76) Inventor: Jesse Y. Harris, Jr., 4770 Lost Colony Ct., Stone Mountain, GA (US) 30088

( * ) Notice: Subject to any disclaimer, the term of this patent is extended or adjusted under 35 U.S.C. 154(b) by 0 days.

(21) Appl. No.: 12/454,760

(22) Filed: May 26, 2009

(51) Int. Cl.
*A63B 21/008* (2006.01)

(52) U.S. Cl. ..... 482/112; 482/138

(58) Field of Classification Search ..... 482/44, 482/56, 62, 72, 73, 92, 111–113, 130, 138, 482/142
See application file for complete search history.

(56) References Cited

U.S. PATENT DOCUMENTS

| | | | | | |
|---|---|---|---|---|---|
| 4,291,787 | A | | 9/1981 | Brentham | |
| 4,421,307 | A | * | 12/1983 | Cunnington et al. | 482/72 |
| 4,541,627 | A | * | 9/1985 | MacLean et al. | 482/73 |
| 4,618,144 | A | | 10/1986 | Gibson | |
| 4,629,185 | A | * | 12/1986 | Amann | 482/113 |
| 4,718,664 | A | * | 1/1988 | Carpenter | 482/112 |
| 4,722,525 | A | | 2/1988 | Brentham | |
| 4,750,736 | A | * | 6/1988 | Watterson | 482/73 |
| 4,786,051 | A | | 11/1988 | Mullican | |
| 4,796,881 | A | * | 1/1989 | Watterson | 482/73 |
| 4,867,447 | A | * | 9/1989 | Johnson | 482/73 |
| 4,872,668 | A | * | 10/1989 | McGillis et al. | 482/113 |
| 4,909,504 | A | * | 3/1990 | Yang | 482/112 |
| 4,915,379 | A | | 4/1990 | Sapp | |
| 4,979,736 | A | | 12/1990 | Maynard | |
| 4,981,199 | A | * | 1/1991 | Tsai | 188/312 |
| 5,037,088 | A | | 8/1991 | Bernstein | |
| 5,180,353 | A | | 1/1993 | Snyderman | |
| 5,372,564 | A | * | 12/1994 | Spirito | 482/112 |
| 5,397,287 | A | | 3/1995 | Lindfors | |
| 5,658,225 | A | * | 8/1997 | Huang | 482/72 |
| 6,436,006 | B1 | | 8/2002 | Zemlyakov et al. | |
| 6,592,498 | B1 | | 7/2003 | Trainor | |
| 7,276,018 | B2 | * | 10/2007 | Studdard | 482/142 |
| 7,575,539 | B2 | * | 8/2009 | Kessler | 482/138 |

FOREIGN PATENT DOCUMENTS

| | | | |
|---|---|---|---|
| DE | 4214629 | A1 * | 11/1993 |
| FR | 2625907 | A1 * | 7/1989 |
| FR | 2643821 | A1 * | 9/1990 |
| JP | 05076620 | A * | 3/1993 |

* cited by examiner

*Primary Examiner*—Loan Thanh
*Assistant Examiner*—Victor K Hwang
(74) *Attorney, Agent, or Firm*—Richard L. Mikesell

(57) ABSTRACT

A collapsible device includes extendable hydraulic cylinders mounted on a base by swivel joints and which are amenable to use with a plurality of different grips whereby the device is amenable to a wide variety of exercises.

8 Claims, 7 Drawing Sheets

MULTI-AXIS, MULTI-PLANAR MULTI-EXERCISE COLLAPSIBLE EXERCISE DEVICE

TECHNICAL FIELD OF THE INVENTION

The present invention relates to the general art of exercise, and to the particular field of exercise devices.

BACKGROUND OF THE INVENTION

Today, good health is highly emphasized in our society. Proper maintenance of the cardiovascular system and various muscle groups requires a great deal of exercise.

Weight lifting is a popular type of exercise that provides a very effective means to achieve and maintain good health. The traditional method of weight lifting is "free" weight lifting. Free weight lifting is generally performed with barbells and dumbbells. A major advantage of free weight training is that it allows the user maximum freedom to exercise against a selected resistance in any manner chosen. The user is however confined to working against gravity. No resistance can be provided when moving the weights in a downwards direction. Furthermore, due to the danger and complexity involved, free weight exercises have been replaced to a large extent with exercises performed on exercise machines. Exercise machines provide more efficient ways to exercise and are much easier and safer to use.

An exercise machine operates by providing resistance to various exercising forces exerted or applied by the exerciser or machine operator. Most conventional exercise machines utilize adjustable weight stacks to provide the resistance.

Although machine weight lifting has many advantages over free weight lifting, conventional weight machines are not suitable in all applications. Most conventional machines are too expensive for the individual weight lifter to afford. It is often very burdensome, time consuming and dangerous for the operator to adjust the weights. The conventional weight machines are generally too heavy to be moved, and take up a great deal of space. The constant sound of clashing weights makes the machines too noisy for many environments.

In addition, conventional weight machines are not suitable for certain types of exercises. The weights provide both positive and negative resistance. Positive resistance is created when the weights are lifted or pushed. Negative resistance is created when the weights are lowered or released. For some types of exercises, particularly "rapid thrust" type exercises, the sudden transfer of supporting energy from one set of muscles to another created by a sudden change in resistance can cause muscular strains and other injuries.

Therefore, there is a need for an exercise machine which does not rely on free weights for the resistance aspect of the movements.

There are numerous types of exercise machines and apparatus for use by individuals who wish to improve their overall physical fitness and strength. Many of the same machines are also used in the medical profession for physical therapy for patients recovering from injury or sickness.

Exercise devices are often used to simulate aerobic exercises such as rowing, cross-country skiing, and stair climbing. The use of aerobic exercise devices is preferred as they can provide a continuous, steady work-out at a convenient location, for example, at home or an exercise facility. In order to more closely simulate a particular activity, these exercise devices are equipped with hydraulic and/or mechanical devices that provide a resistive force to arm and leg movement. A typical stair-stepping type exercise device employing a hydraulic device for providing the desired resistive force is marketed by CSA, Inc. under the trademark ALPINE CLIMBER.

It is well known that exercising devices generally serve two purposes, the strengthening and rehabilitation of muscles. The older exercising devices generally use a series of pulleys and ropes for lifting weights.

Furthermore, athletes and other performers and artists, such as dancers, must regularly perform various specific physical exercises to maintain proper body conditioning. While traveling, the performance of such exercises may be inconvenient or impossible since many of the exercise routines require exercise machines or devices which heretofore were large and cumbersome and required attachment to a building support. Additionally, the size and immobility of the prior exercise devices restricted utilization in space-limited environments, such as apartments, offices, etc. It is generally important to these users for the exercise device to include at least some means for exercising the specific muscles that they primarily use. For example, a golfer may wish to exercise his or her core muscles in a golf swing motion, or the like.

Therefore, there is a need for a self-contained, hand-transportable portable exercise device for performing upper and lower body exercises.

There is a further need for a stable, freestanding portable exercise device which can be assembled into a compact, space efficient configuration.

There is yet a further need for a self-contained portable exercise device that is convenient for travel and space efficient for storage and use.

There is still further need for an exercise device that can be used to exercise specific muscles used in a specific manner.

A good exercising device should enable motions of exercise which alternately stress the agonist or antagonist. In each exercise, a muscle or a combination of muscles is working. In the compulsory return motion, the counteracting muscle or group of muscles is working. One-sided training resulting in uneven distribution of the muscles is counteracted by means of devices having a double-acting function. For optimum results, the muscle is to be exercised under maximum load during the entire movement. The training should be effected entirely on the exercising person's conditions and not on the conditions of the device, which applies both to sound persons and to those with reduced functions, the device preferably being settable in the range 1 kP-300 kP.

Double-acting training of groups of muscles counter-acting each other produces a flow of blood to the working muscles, which is constantly high during the exercise. By alternatively contracting and stretching the muscles they are made smoother and more flexible. The double-acting function, which is desired in an exercising device, is used by physiotherapists, inter alia for relieving the patients' muscles of tension and for increasing the patients' muscular strength. The physiotherapist's manual and strenuous can in many cases be taken over by a well-functioning exercising device by means of which the patient can exercise on his own according to instructions, without the physiotherapist's assistance. Finally, a well-functioning exercising device should permit exercising of all large group of muscles, but most of the exercising devices available on the market are not designed for this, but only for separate exercises.

Therefore, there is a need for an exercising device having a double-acting function, for exercising all large groups of muscles in the body.

Many types of multi-purpose exercise devices have been proposed, and Nautilus and other large bulky and expensive machines are enjoying widespread popularity. However, many persons cannot afford the time or money to visit a health club where the large exercise apparatus is normally found, nor do they wish to set aside a large portion of their living quarters to accommodate such a large and costly apparatus. Accordingly, there is a significant need for a small or compact and versatile exercising apparatus.

SUMMARY OF THE INVENTION

The above-discussed disadvantages of the prior art are overcome by a collapsible device that includes extendable hydraulic cylinders mounted on a base by swivel joints and which are amenable to use with a plurality of different grips whereby the device is amenable to a wide variety of exercises.

The use of hydraulic systems for providing the resistive force utilized in exercising equipment is preferred since these systems have relatively few moving parts and are reliable. In general, the hydraulic system of the exercise device embodying the principles of the present invention includes a cylinder and a piston that is reciprocally mounted in the cylinder. One of either the piston or the cylinder is mounted to a stationary member and the other one of the piston and cylinder is attached to a movable member. The desired hydraulic resistive force is produced by the restricted flow of a working fluid, for example, a hydraulic fluid, that is contained within the cylinder.

In accordance with the invention, an exercising device comprises a frame for supporting a human body, actuating apparatus mounted with the frame for movement by the portion of the body, and a double acting hydraulic cylinder connected to the frame for resisting movement of the actuating apparatus. The cylinder includes a container with first and second chambers for supporting a fluid disposed therein and passageways for placing the chambers in fluid communication with one another. A piston is slidably mounted within the first chamber for acting on the fluid disposed therein and the piston has a passageway for placing a portion of the first chamber on one side of the piston in fluid communication with the portion of the first chamber on the other side. A piston rod extends from the piston out of the container for moving the piston in response to movement of the actuating means and valve means are used for limiting fluid flow through a selected passageway from the first chamber to the second chamber. A control means is connected to the cylinder for governing the fluid flow through the selected passageway to regulate the amount of force necessary to move the actuating means.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
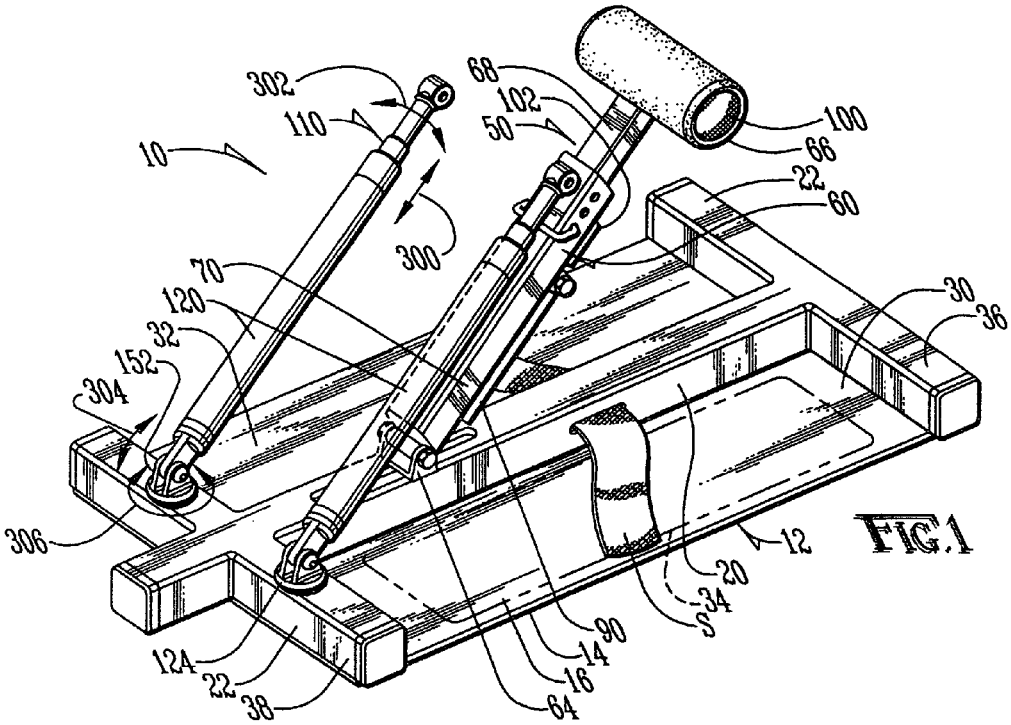
FIG. 1 is a perspective view of an exercise device embodying the principles of the present invention.
Figure 2:
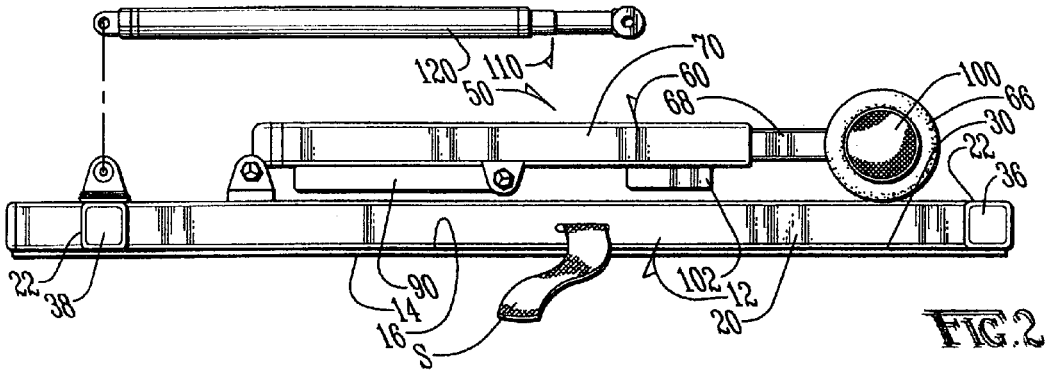
FIG. 2 is a side elevational view of the exercise device in the collapsed condition.

Referring to the figures, it can be understood that the present invention is embodied in an exercise device 10 which can be used in a deployed condition shown in FIG. 1 or stored in a collapsed condition shown in FIG. 2. As shown in FIG. 2, a strap S can be used to securely hold the elements of the device together during storage.

Exercise device 10 includes a base 12 which has a lower surface 14 which rests on a support surface, such as a floor, and which has a top surface 16 on which support bars 20 and 22 are mounted. Support bar 20 extends in the longitudinal direction of the base and divides the base into two foot-accommodating areas 30 and 32 and a pad 34 can be mounted on the top surface if desired. Support bars 22 extend in the transverse direction of the base and are located at ends 36 and 38 of the base.

Figure 5:
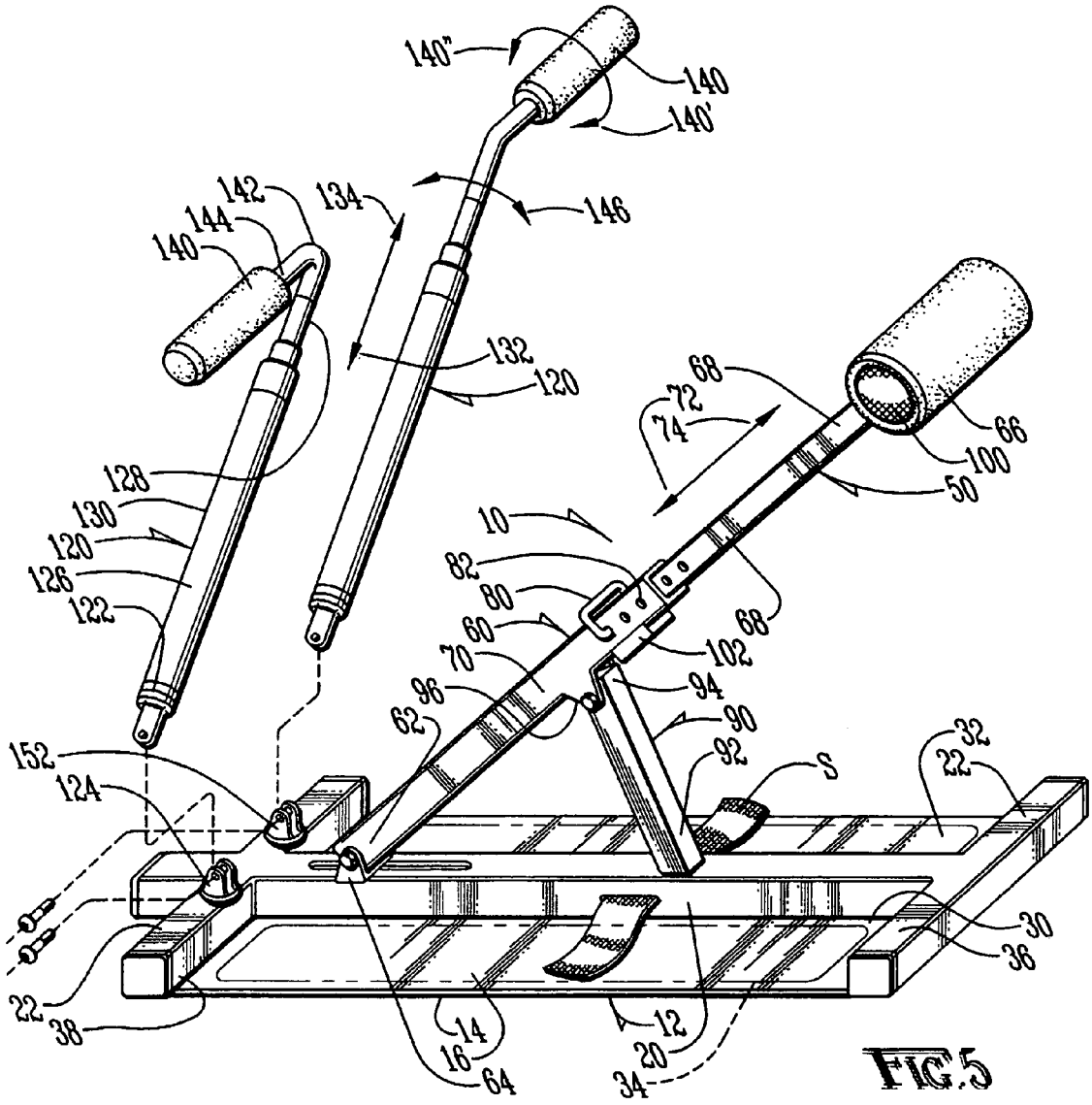
FIG. 5 is a perspective view of the exercise device in a partially disassembled condition.

As can best be seen in FIG. 5, a first unit 50 is mounted on support bar 20 to extend in the longitudinal direction of the base. Unit 50 includes a telescoping unit 60 having a proximal end 62 pivotally mounted on bar 20 by a pivot joint 64 and a pad 66 mounted on a distal end of a piston 68 which is slidably received in section 70 of unit 60 to move into and out of section 70 in directions 72 and 74 to adjust unit 60 to the exercise and size of the user. A fastening pin 80 is accommodated in fastener holes 82 in section 70 which are aligned with corresponding fastener holes in cylinder 68 to lock cylinder 68 to section 70 in the set condition. A support arm 90 is attached at a distal end 92 thereof to bar 20 and at a proximal end 94 thereof to section 70 by a pivot joint 96. Pivot joint 96 can be slidably mounted in directions72 and 74 on section 70 and can include locking fasteners to hold the section in a desired position.

A speaker 100 for an audio system can be mounted in pad 66 and a timer 102 can be mounted on section 70.

Figure 6:
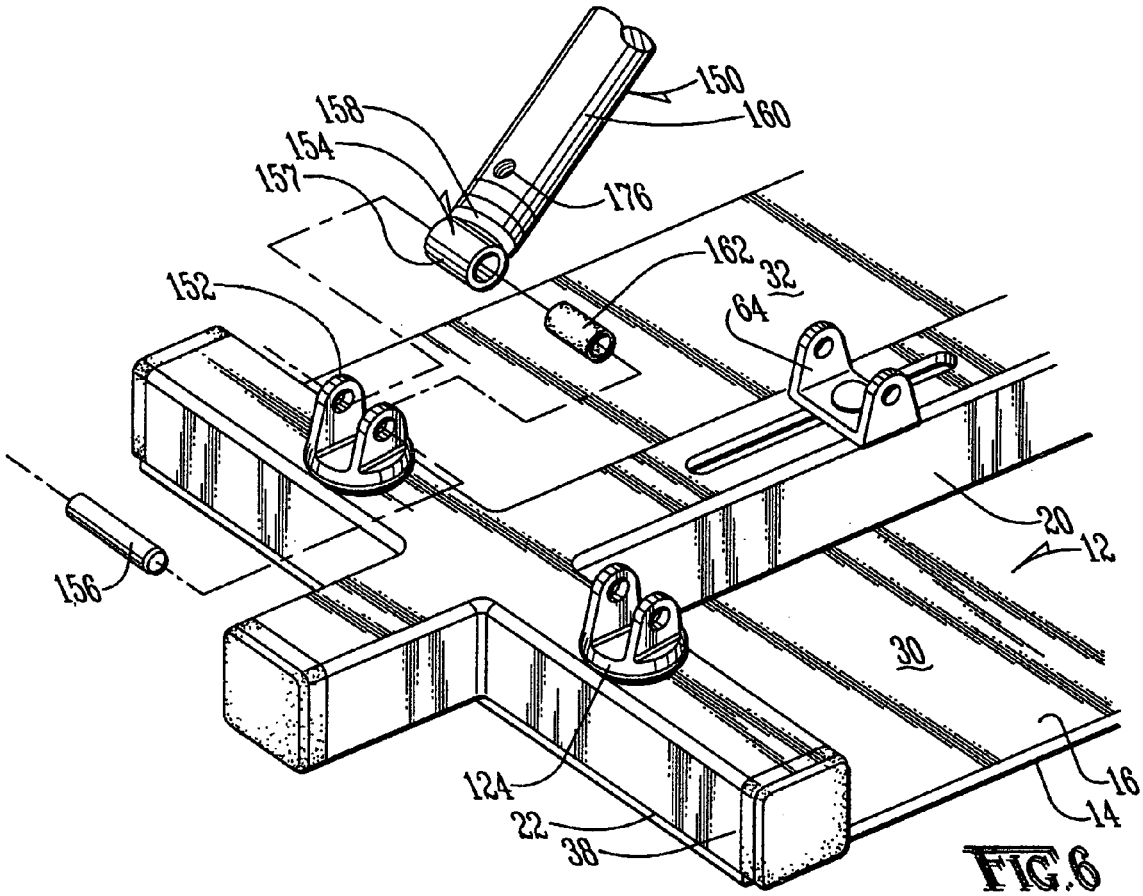
FIG. 6 is a perspective view of a connection between the handles and the base of the exercise device of the present invention.

Two handle units 110 are mounted on a bar 22 adjacent to end 36 of the base. These handle units are identical, therefore, only one handle unit will be described. As shown in FIGS. 5 and 6, proximal end 122 of handle unit 120 is mounted on bar 22 by a swivel joint 124 and includes a section 126 which has at least one bar 128 telescopingly accommodated in an outer section 130 and which moves into and out of the outer section in directions 132 and 134 against the resistance of a hydraulic fluid located in the handle. A hand grip element 140 is mounted on distal end 142 of the innermost section 144 of handle unit 120. Thus handle unit 120 moves in a multitude of directions in all planes whereby a full exercise routine can be carried out while taking advantage of the resistance of the hydraulic system. Furthermore, handgrip element 140 can rotate with respect to the handle as indicated by arrows 140' and 140" in FIG. 5. As indicated by arrow 146 in FIG. 5, the handles have elements that can rotate with respect to each other to provide further versatility to the device.

Figure 7:
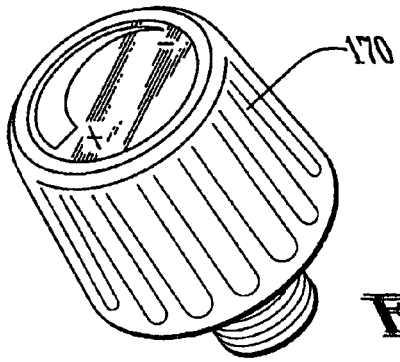
FIG. 7 shows one form of air regulator which is used in conjunction with the hydraulic handles of the exercise device of the present invention.
Figure 8:
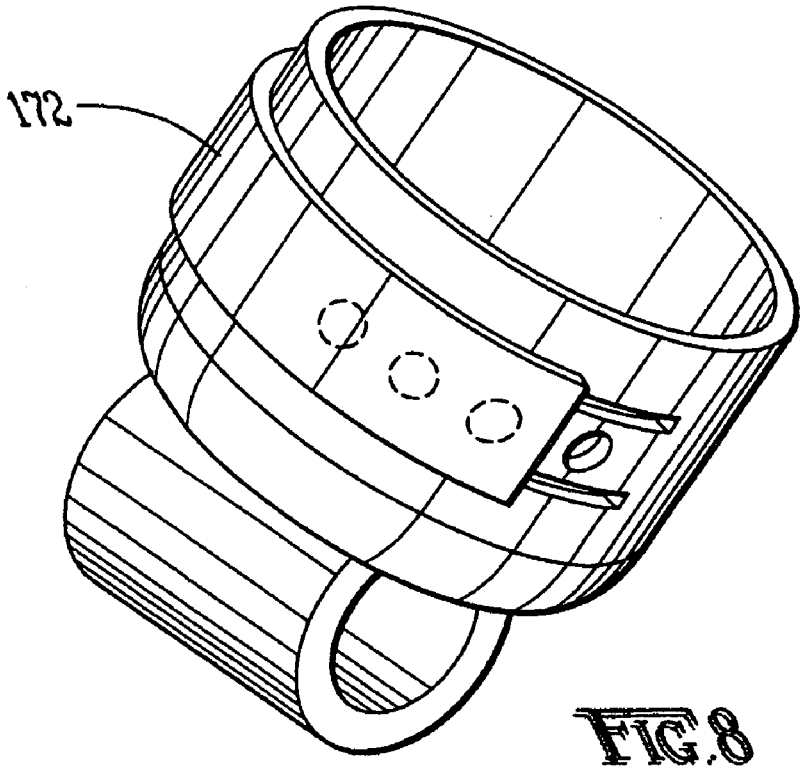
FIG. 8 shows another form of air regulator which is used in conjunction with the hydraulic handles of the exercise device of the present invention.
Figure 9:
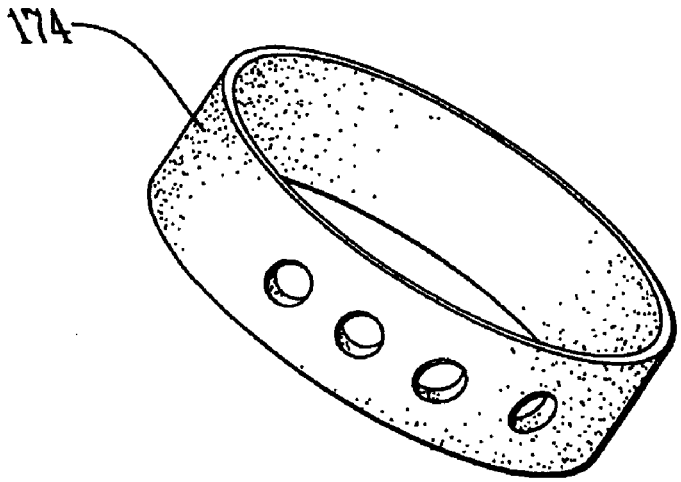
FIG. 9 shows a rubber shield used in conjunction with the air regulators.

Yet a further handle, handle 150, can be mounted on bar 22. Handle 150 is shown in FIG. 6 is hydraulically controlled and is connected to bar 22 by a swivel joint 152 by a connection unit 154 which includes a pivot pin 156 accommodated in a housing 157 on proximal end 158 of an outer cylinder 160 of handle 150. A rubber bearing element 162 is also included in the joint 152. Handle 150 is hydraulically controlled and includes an air pressure regulator, such as regulator 170 shown in FIG. 7 or a regulator 172 shown in FIG. 8, mounted in the proximal end of handle 150 by means of a rubber seal 174. Suitable ports, such as port 176, are defined in the handle for proper venting of the hydraulic system as will be understood by those skilled in the art based on the teaching of this disclosure.

Figure 3:
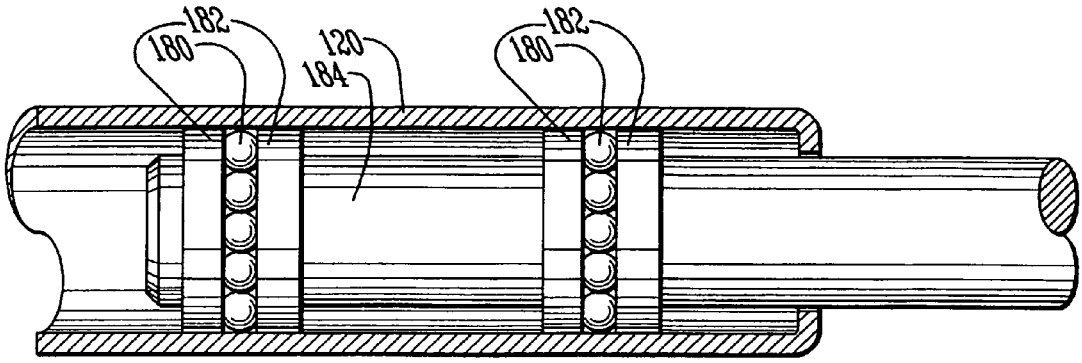
FIG. 3 shows a portion of a hydraulic handle used by the exercise device of the present invention.
Figure 4:
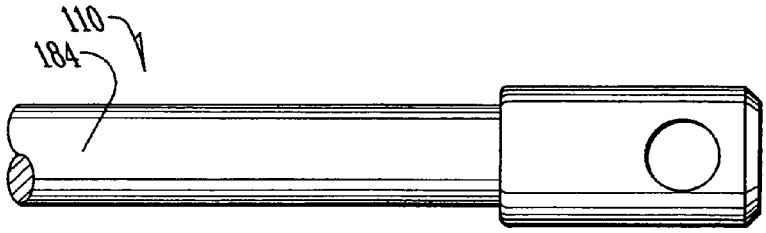
FIG. 4 shows a distal end of the hydraulic handle.

The hydraulic handles are partially shown in FIGS. 3 and 4 and include ball bearing units 180 interposed between adjacent sections of the handle with suitable seals, such as seal 182 enclosing the ball bearing units so the sections of each handle will slide with respect to each other in a manner which will be understood by those skilled in the art based on the teaching of this disclosure. Each handle unit includes a piston, such as piston 184, and there can be multiple piston sizes for executing a plurality of different exercises.

Figure 10:
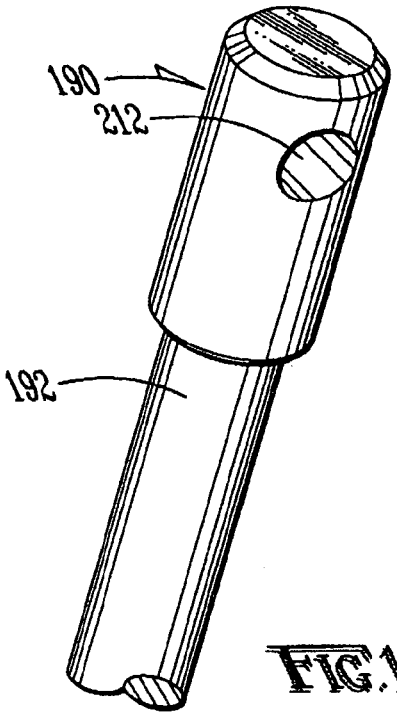
FIG. 10 shows a coupling joint used to couple a handle to the distal end of a hydraulic handle of the exercise device of the present invention.
Figure 11:
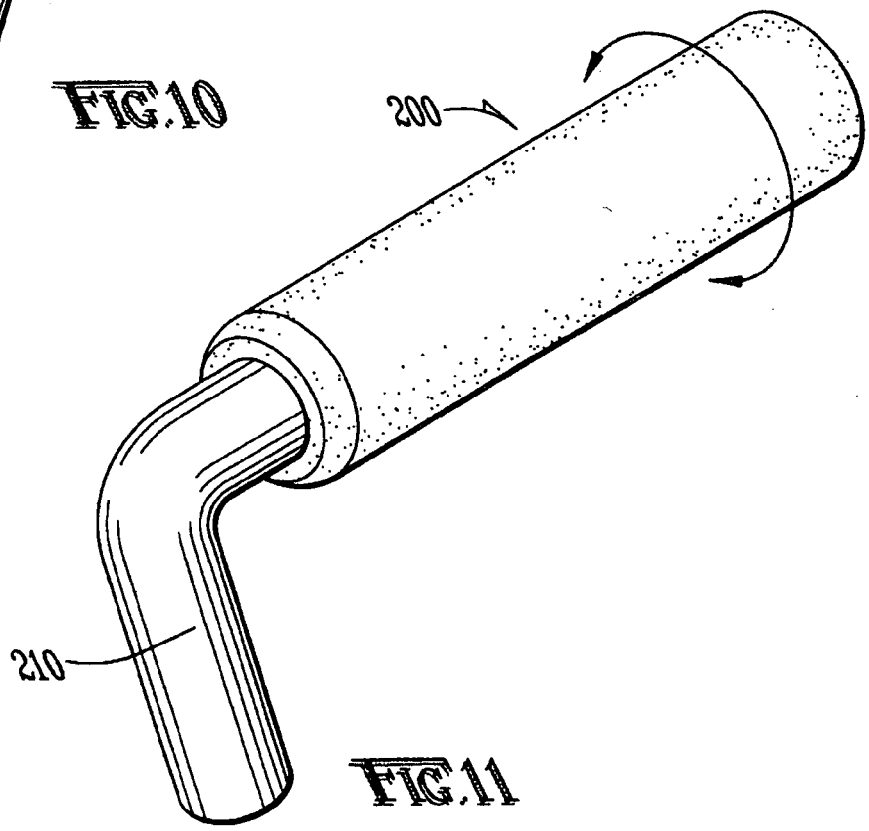
FIG. 11 shows one form of hand grip used on the exercise device of the present invention.
Figure 12:
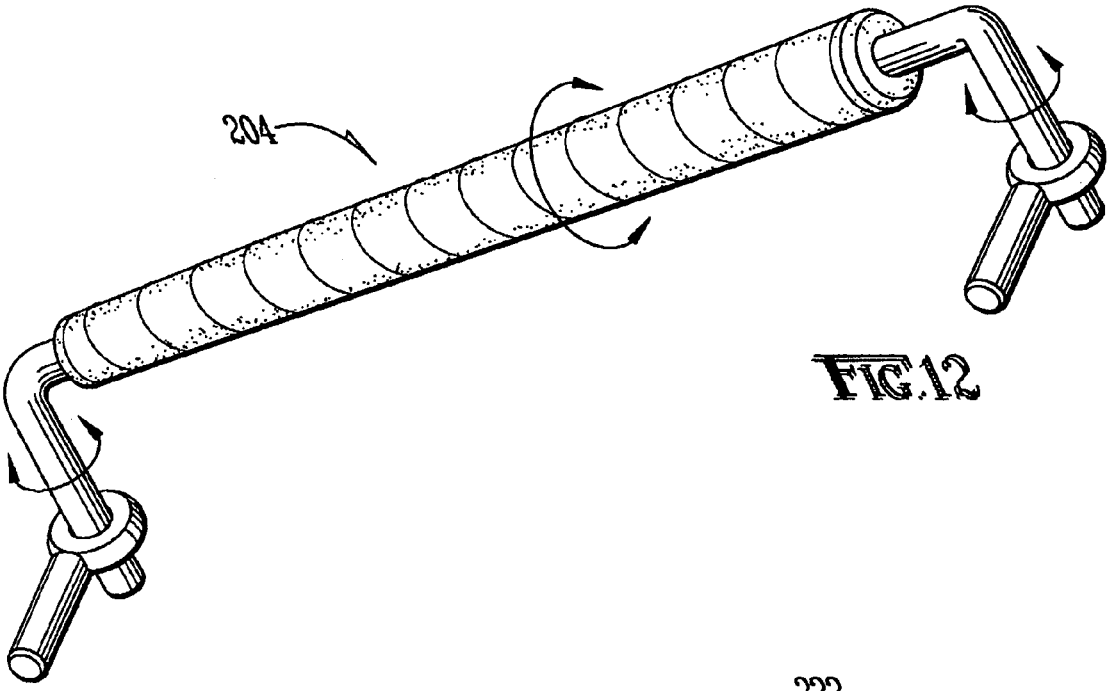
FIG. 12 shows a hand grip which is in the form of a golf club grip.
Figure 13:
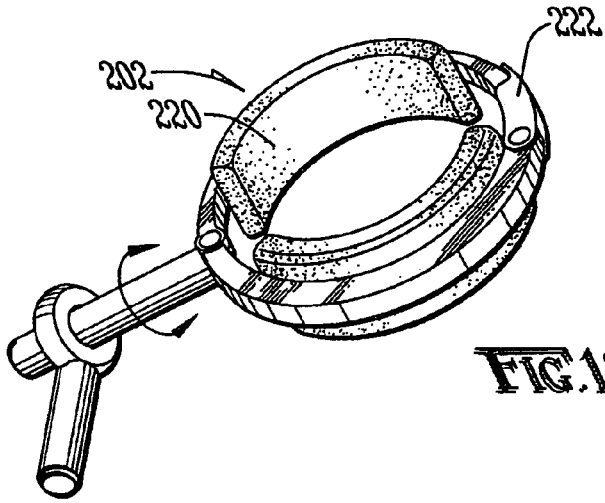
FIG. 13 shows an ankle attachment used on the exercise device of the present invention.

Referring to FIG. 10, a cap element 190 is mounted on distal end 192 of the innermost section of each handle and serves as a quick connect/disconnect element for various hand grips elements, such as standard hand grip 200 (FIG. 11), leg grip 202 (FIG. 13) or golf hand grip 204 (FIG. 12) each of which includes a projection 210 which is accommodated in transverse bore 212 defined in cap element 190 to attach the hand grip element to the handle unit of device 10. As shown, hand grip 200 can be rotatable so it can accommodate suitable hand movement and leg grip 202 includes cushions 220 and a clamp 222 while grip 204 is in the shape of a golf hand grip and can be connected to the handle units of the exercise device at either end thereof. The golf hand grip is also rotatable so a user can execute a swing motion against the resistance of the handles to strengthen his or her core.

The handle units can be extended to as much as eight feet to accommodate a large variety of exercises while the hand grips allow rotation so the desired motions can be executed while exercising a plurality of muscles, at least two, on each set.

In accordance with the invention, it is possible to include double acting hydraulic cylinders, each of which comprises an inner tube disposed within an outer tube. Head and base members can be used to close the ends of the tubes with each head and base member having a passageway for placing fluid disposed within the inner and outer tubes in communication. A piston can be slidably mounted within the inner tube for acting on the fluid disposed therein and can have a passageway extending therethrough for placing the fluid on one side of the piston in fluid communication with the fluid on the other side. A piston rod for moving the piston can be mounted with the piston and extends through the head member to displace fluid in the inner tube. A first valve can be mounted in the base member passageway to prevent fluid communication therethrough when the piston is moved toward the base member and a second valve can be mounted in the piston passageway for preventing fluid communication therethrough when the piston is moved toward the head member. The valves and piston rod, thus, would coact so that fluid in the inner tube will always flow through the head member passageway to the outer tube when the piston is moved.

The swivel joints and the hydraulic systems allow the handles to move in a plurality of movements, including a movement which is along the longitudinal axis of the handle as indicated in FIG. 1 by double-headed arrow 300, and a movement which is in a rotational direction with respect to the longitudinal axis of the handle as indicated by double-headed arrow 302 in FIG. 1 as well as a pitch direction as indicated by double-headed arrow 304 in FIG. 1 and a yaw axis as indicated by double-headed arrow 306 in FIG. 1, all while operating against a double resistance of a hydraulic system. The handles can thus be located in a multitude of planes. Thus, a large variety of exercises can be executed and proper exercise motions for each exercise can be carried out.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. An exercise device comprising:

a) a base;

b) a first unit mounted on the base, the first unit including a first portion telescopingly accommodated in a second portion to move into and out of the second portion, a pad fixed on a distal end of the first portion, a rigid elongate support arm connecting the second portion to the base, the first unit being adapted to move between a stored condition with the distal end located closely adjacent to the base and a use condition having the distal end spaced apart from the base;

c) two identical handle units, each handle unit including a first section telescopingly accommodated in a second section to move into and out of the second section, a hand-grip connection element on a distal end of the first section, each handle unit being adapted to move between a stored condition with the distal end thereof located closely adjacent to the base and a use condition having the distal end thereof spaced apart from the base;

d) each handle unit including a hydraulic system for controlling movement of the first section with respect to the second section;

e) a swivel joint connecting a proximal end of each handle unit to the base, whereby each handle unit can move rotationally with respect to the base while the first section of each handle unit can move linearly with respect to the base.

2. The exercise device defined in claim 1 further including a hand grip element mounted to a distal end of one of the handle units.

3. The exercise device defined in claim 2 wherein the hand grip element is in the form of a golf club hand grip.

4. The exercise device defined in claim 1 further including an ankle grip element mounted to a distal end of one of the handle units.

5. The exercise device defined in claim 1 further including a timer mounted on the first unit.

6. The exercise device defined in claim 1 further including an audible system on the first unit.

7. The exercise device defined in claim 1 further including a strap connected to the base and sized and located to encircle the base when the first unit and the handle units are in the stored condition to hold the first unit and the handle units in the stored condition on the base.

8. The exercise device defined in claim 1 wherein the hand-grip connection elements are each mounted on the handle units to rotate with respect to the handle unit on which it is mounted.

* * * * *